US006308879B1

(12) United States Patent
Wang

(10) Patent No.: US 6,308,879 B1
(45) Date of Patent: Oct. 30, 2001

(54) DEVICE FOR POSITIONING NAILS IN A TUBE OF A NAILER

(75) Inventor: Rui-Chang Wang, Ta Li (TW)

(73) Assignee: Besco Pneumatic Corp., Taichung Hsien (TW)

( * ) Notice: Subject to any disclaimer, the term of this patent is extended or adjusted under 35 U.S.C. 154(b) by 0 days.

(21) Appl. No.: 09/550,250

(22) Filed: Apr. 14, 2000

(51) Int. Cl.[7] ..... B25C 1/04
(52) U.S. Cl. ..... 227/113; 227/119; 227/130
(58) Field of Search ..... 227/113, 119, 227/130, 131, 147

(56) References Cited

U.S. PATENT DOCUMENTS 2,829,369 * 4/1958 Browning ..... 227/113
3,820,705 * 6/1974 Beals ..... 227/113
3,979,040 * 9/1976 Denin ..... 227/147
4,611,739 * 9/1986 Rowton ..... 227/113
5,074,453 * 12/1991 Tachihara et al. ..... 227/119
5,647,525 * 7/1997 Ishizawa ..... 227/130
6,145,723 * 11/2000 Gupta ..... 227/113

* cited by examiner

*Primary Examiner*—Scott A. Smith
(74) *Attorney, Agent, or Firm*—Rosenberg, Klein & Lee

(57) ABSTRACT

A nailer includes a head and a tube is connected to a bottom of the head. A protrusion extends from an inside of the tube and an aperture is defined through the protrusion and the tube. A magnet is engaged with the aperture and a position member is mounted to the tube and seals the aperture so that the magnet will not drop from the aperture. The protrusion ensures a nail attracted by the magnet to orient an upright direction before it is ejected.

3 Claims, 6 Drawing Sheets

DEVICE FOR POSITIONING NAILS IN A TUBE OF A NAILER

FIELD OF THE INVENTION

The present invention relates to a nailer that has a ring enclosing a magnet in a tube to prevent loss of the magnetic force of the magnet. A protrusion extends from an inside of the tube to avoid nails from being inclined relative to a longitudinal axis of the tube.

BACKGROUND OF THE INVENTION

A conventional pneumatic nailer is illustrated in FIG. 1 and generally includes a head 10 connected to pneumatic source and a neck 12 extends from the head 10. A tube 11 is connected to the neck 12 and has a magnet 15 engaged in the tube 11 so as to attract nails 13 in the tube 11 before the nails 13 are ejected into an object 14. In order to maintain the magnetic force of the magnet 15 in the tube 11, the material of the tube 11 has to be especially chosen so that the feature of the magnet 15 will not fail. However, the material of the tube 11 is expensive. Besides, nails 13 in the tube 11 tend to be inclined relative to a longitudinal axis of the tube 11 as shown because the diameter of the tube 11 is larger than the nails 13. Therefore, the nails 13 could be ejected into the object 14 inclinedly. Furthermore, the magnet 15 could drop from the tube 11 by vibration.

The present invention intends to provide a nailer that has a positioning means to securely position the magnet in the tube. A protrusion extends from an inside of the tube to let the nails attracted by the magnet orient a correct direction in the tube.

SUMMARY OF THE INVENTION

In accordance with one aspect of the present invention, there is provided a nailer comprising a head having a neck connected to a bottom of the head and a tube extending from the neck. A protrusion extends from an inside of the tube and an aperture is defined through the protrusion and the tube so as to receive a magnet in the aperture. A position member is mounted to an outside of the tube and seals the aperture.

The object of the present invention is to provide a nailer wherein nails attracted by the magnet are arranged to orient an upright direction so that every nail can be ejected as desired into an object.

Another object of the present invention is to provide a nailer with a position member mounted to the tube so as to prevent a magnet in the tube from dropping from the aperture in the tube by vibration.

These and further objects, features and advantages of the present invention to will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
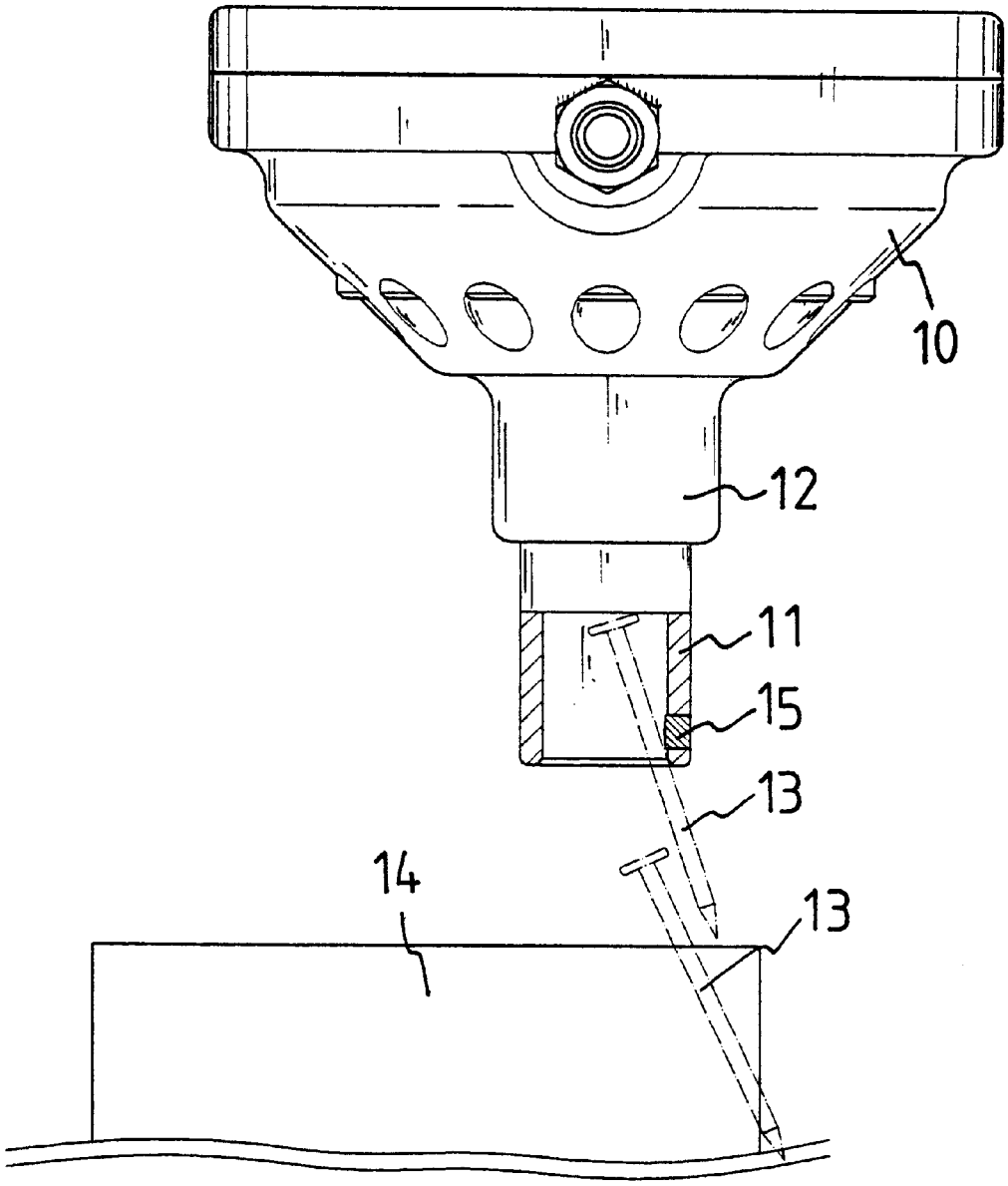
FIG. 1 PRIOR ART
FIG. 1 is an illustrative view to show a conventional nailer and a nail attracted by the magnet is inclined relative to the longitudinal axis of the tube.
Figure 2:
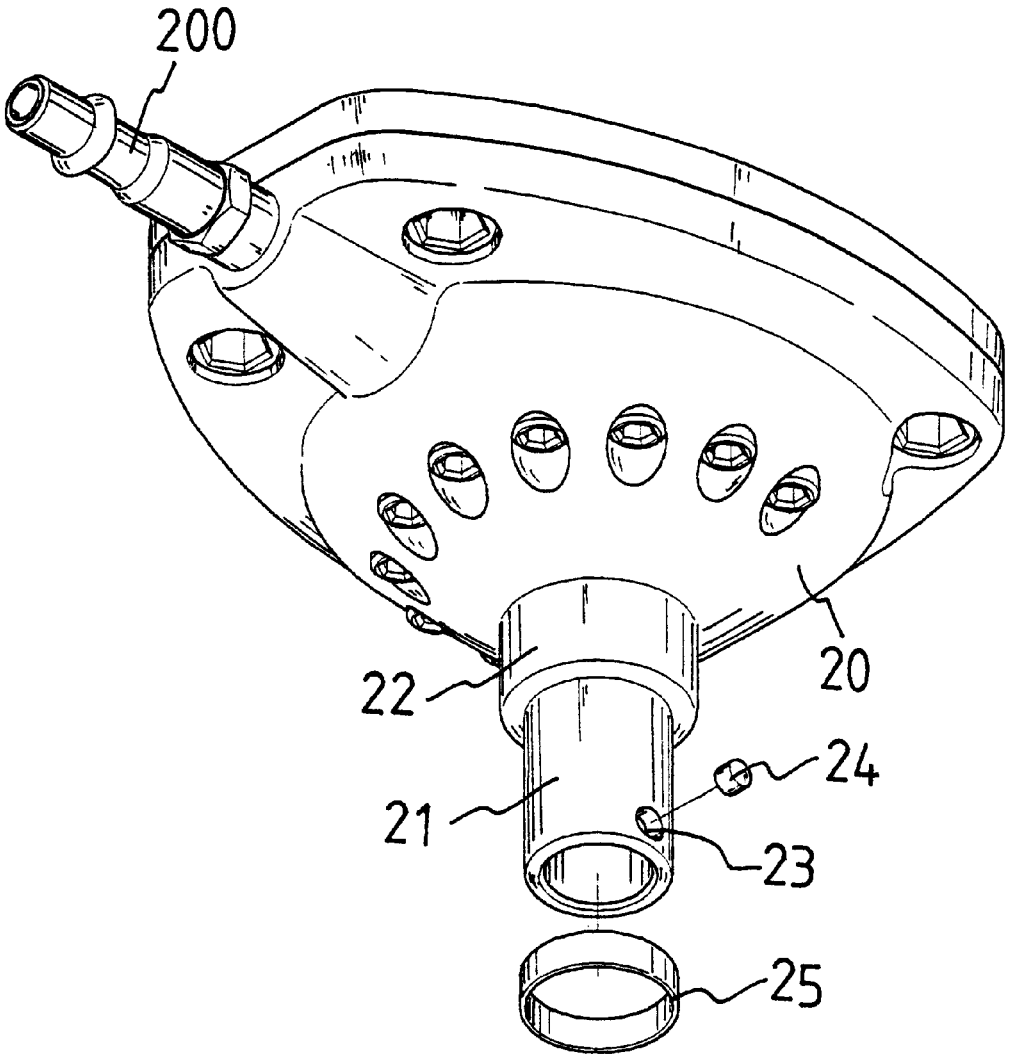
FIG. 2 is an exploded view to show a nailer of the present invention wherein a magnet is to be engaged with an aperture in the tube and a position member is to be mounted to the tube.
Figure 3:
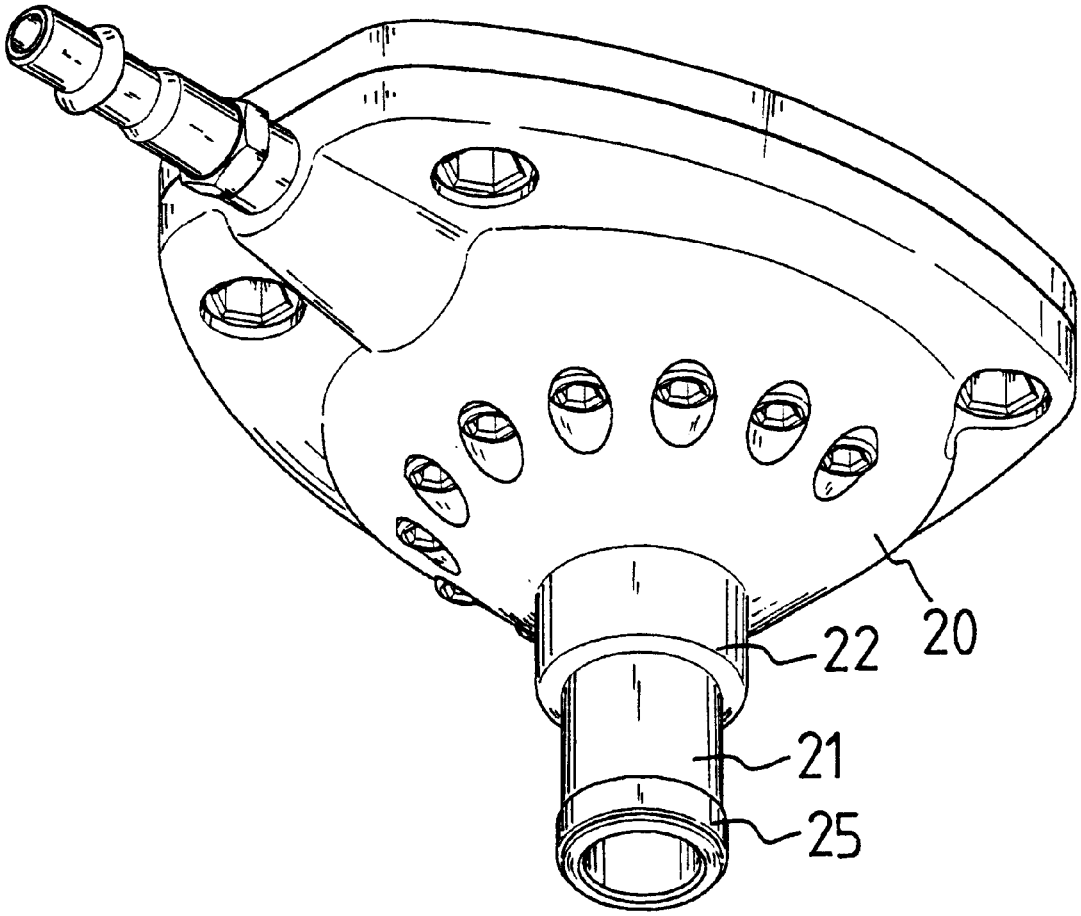
FIG. 3 is a perspective view to show the nailer of the present invention.
Figure 4:
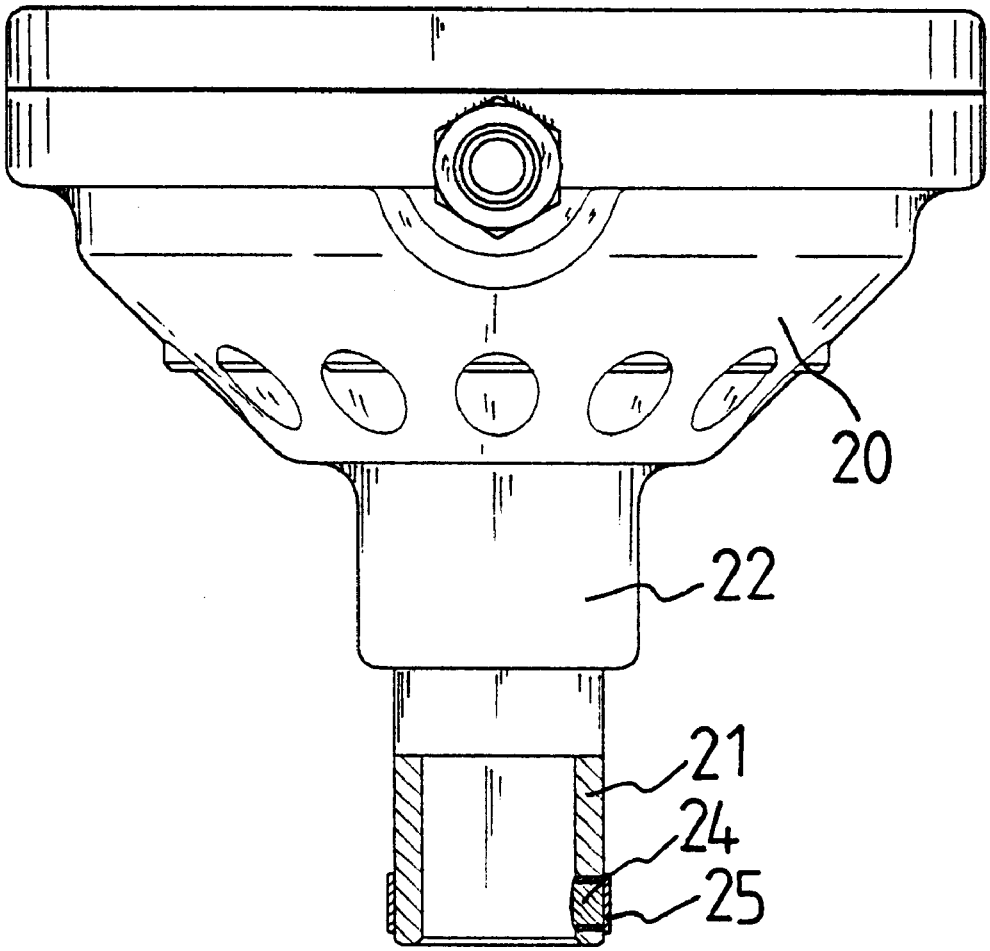
FIG. 4 is a side elevational view, partly in section, of the nailer of the present invention.
Figure 6:
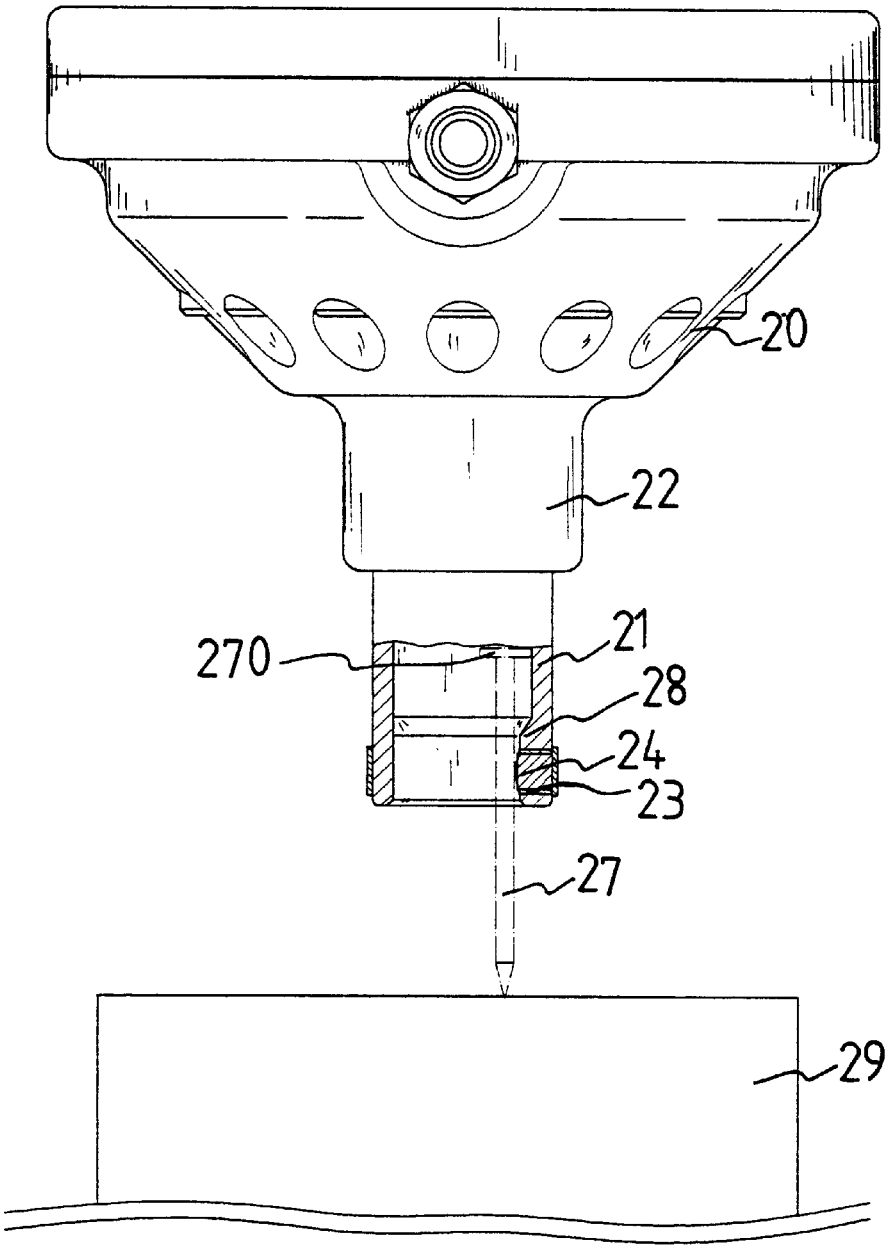
FIG. 6 is a side elevational view, partly in section, of the nailer of the present invention, wherein a nail attracted by the magnet is oriented an upright direction in the tube.

Referring to FIGS. 2 to 4, the nailer in accordance with the present invention comprises a head 20 having a connection tube 200 to be connected to a hose from a pneumatic source. A neck 22 is connected to a bottom of the head 20 and a tube 21 extends from the neck 22. A protrusion 28 extends from an inside of the tube 21 and an aperture 23 is defined through the protrusion 28 and the tube 21. A magnet 24 is engaged with the aperture 23. A position member 25 is mounted to an outside of the tube 21 and seals the aperture 21 so that the magnet 24 will not drop from the aperture 23. As shown in FIG. 6, a nail 27 in the tube 21 is attracted by the magnet 24 will be oriented to an upright direction as shown because a mediate portion of the nail 27 is pushed toward a central axis of the tube 21. The thickness of the protrusion 28 is about a distance of a head of the nail 27 extending from a top of the nail 27. Therefore, when the nail 27 is ejected into an object 29, the nail 27 perpendicularly penetrates into a top of the object 29.

Figure 5:
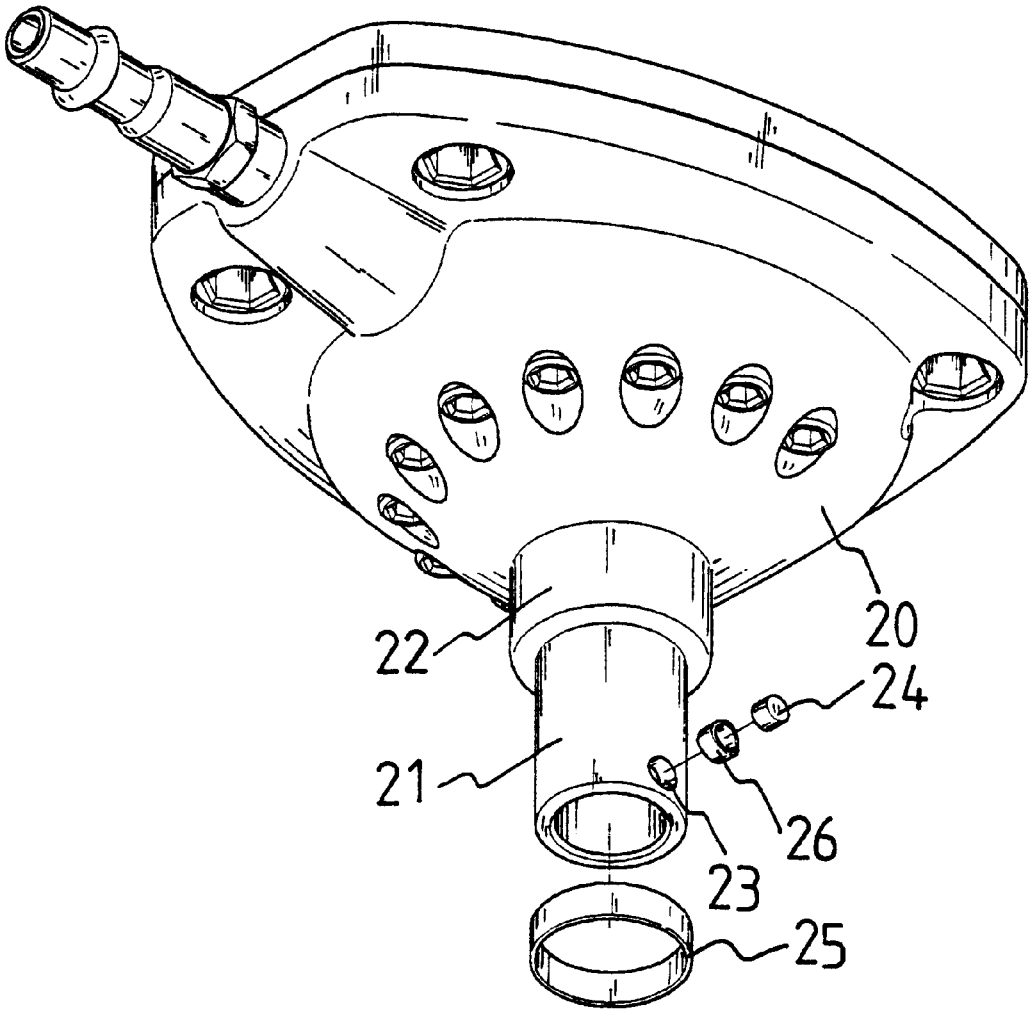
FIG. 5 is an exploded view to show the nailer of the present invention wherein a ring is to be engaged between the magnet and a periphery defining the aperture in the tube.

Referring to FIG. 5, a ring 26 can be engaged with the aperture 23 and is located between the magnet 24 and a periphery defining the aperture 23. The ring 26 is made of a material that will keep the magnetic force from lost.

While we have shown and described various embodiments in accordance with the present invention, it should be clear to those skilled in the art that further embodiments may be made without departing from the scope and spirit of the present invention.

What is claimed is:

1. A nailer comprising:

a head having a neck connected to a bottom of said head, a tube extending from said neck and a protrusion extending from an inside of said tube, an aperture defined through said protrusion and said tube, a magnet engaged with said aperture, and a position member mounted to an outside of said tube and sealing said aperture.

2. The nailer as claimed in claim 1 further comprising a ring engaged with said aperture and located between said magnet and a periphery defining said aperture.

3. A nailer comprising:

a head having a neck connected to a bottom of said head, a tube extending from said neck and a protrusion extending from an inside of said tube, an aperture defined through said protrusion and said tube, a magnet engaged with said aperture and a ring engaged with said aperture and located between said magnet and a periphery defining said aperture, and a position member mounted to an outside of said tube and sealing said aperture.

* * * * *